US006537950B2

(12) United States Patent
Sartori et al.

(10) Patent No.: US 6,537,950 B2
(45) Date of Patent: Mar. 25, 2003

(54) METHOD FOR INHIBITING CORROSION USING TRIPHENYLSTIBINE

(75) Inventors: Guido Sartori, Milan (IT); David Craig Dalrymple, Bloomsbury, NJ (US); Saul Charles Blum, Edison, NJ (US); Liza Marie Monette, Whitehouse, NJ (US); Mohsen S. Yeganeh, Piscataway, NJ (US)

(73) Assignee: ExxonMobil Research and Engineering Co., Annandale, NJ (US)

( * ) Notice: Subject to any disclaimer, the term of this patent is extended or adjusted under 35 U.S.C. 154(b) by 0 days.

(21) Appl. No.: 09/905,228

(22) Filed: Jul. 13, 2001

(65) Prior Publication Data

US 2003/0012682 A1 Jan. 16, 2003

(51) Int. Cl.[7] ..... C23F 11/10; C09K 15/04

(52) U.S. Cl. ..... 507/263; 507/939; 166/242.4; 166/902; 106/14.26; 252/389.54; 252/400.54; 252/49.7; 422/7

(58) Field of Search ..... 252/389.54, 400.54, 252/49.7; 510/258, 270; 507/203, 263, 939, 934; 106/14.05, 14.26; 166/902, 242.4; 427/435; 422/12, 17, 7; 148/320

(56) References Cited

U.S. PATENT DOCUMENTS

| | | | | |
|---|---|---|---|---|
| 3,907,612 A | * | 9/1975 | Atkiss et al. | 148/8 |
| 4,167,471 A | * | 9/1979 | Bertus et al. | 208/74 |
| 4,216,120 A | * | 8/1980 | Nielsen et al. | |
| 4,498,997 A | | 2/1985 | Walker | 252/8.55 |
| 4,941,994 A | | 7/1990 | Zetlmeisl et al. | 252/389.23 |
| 5,552,085 A | | 9/1996 | Babaian-Kibala | 252/389.23 |
| 5,630,964 A | | 5/1997 | Babaian-Kibala | 252/389.23 |

FOREIGN PATENT DOCUMENTS

GB 8667 2/1914

OTHER PUBLICATIONS

Saito, et al., Corros. Sc., vol. 33, No. 8, pp. 1253–1265 (1992).

* cited by examiner

*Primary Examiner*—Joseph D. Anthony
(74) *Attorney, Agent, or Firm*—Linda M. Scuorzo

(57) ABSTRACT

The present invention relates to a method for inhibiting high temperature corrosion of corrosion prone metal surfaces by organic acid-containing petroleum streams by providing an effective corrosion-inhibiting amount of triphenylstibine, typically up to 1000 wppm, to the metal surface.

3 Claims, No Drawings

METHOD FOR INHIBITING CORROSION USING TRIPHENYLSTIBINE

FIELD OF THE INVENTION

The present invention relates to a process for inhibiting the high temperature corrosivity of petroleum oils through the use of a phosphorus-free additive.

BACKGROUND OF THE INVENTION

Whole crudes and crude fractions with acid, including high organic acid content such as those containing carboxylic acids (e.g., naphthenic acids), are corrosive to the equipment used to distill, extract, transport and process the crudes. Solutions to this problem have included use of corrosion-resistant alloys for equipment, addition of corrosion inhibitors, or neutralization of the organic acids with various bases.

The installation of corrosion-resistant alloys is capital intensive, as alloys such as 304 and 316 stainless steels are several times the cost of carbon steel. The corrosion inhibitors solution is less capital intensive, however costs can become an issue.

The effectiveness of phosphorus compounds against corrosion was discovered in 1906 (Coslett, British Patent 8,667 for phosphoric acid), and the use of these compounds is well known for aqueous systems.

Additionally, organic polysulfides (Babaian-Kibala, U.S. Pat. No. 5,552,085), organic phosphites (Zetlmeisl, U.S. Pat. No. 4,941,994), and phosphate/phosphite esters (Babaian-Kibala, U.S. Pat. No. 5,630,964), all of which have been claimed to be effective in hydrocarbon-rich phase against naphthenic acid corrosion. However, their high oil solubility incurs the risk of distillate sidestream contamination by phosphorus. Furthermore, there is also concern for potential downstream impact of phosphorus such as the possibility of catalyst poisoning by phosphorus-containing compounds, and concerns for downstream units.

Antimony compounds have been reported as having corrosion-resistant properties, essentially in aqueous environments. Walker (U.S. Pat. No. 4,498,997) teaches the use of primarily inorganic antimony compounds in complex aqueous formulations used for selective corrosion inhibition in subterranean applications where strong mineral acids are used to increase rock permeability. Triphenyistibine is a notable exception, deemed an ineffective inhibitor in his teachings. Saito et al. (Corrosion Science, Vol. 33, No. 8, pp. 1253–65, 1992) studied the mechanism of corrosion protective films on iron and nickel in strong aqueous mineral acids containing either triphenylstibine or triethylstibine.

There remains a continuing need to develop additional options for mitigating the corrosivity of acidic crudes at lower cost. This is especially true at times of low refining margins and a high availability of corrosive crudes from sources such as Europe, China or Africa using phosphorus-free compounds. Entrained phosphorus contamination in distillate sidestreams can result in downstream catalyst deactivation and/or product quality problems. This precludes addition of such inhibitors to sidestreams subjected to catalytic processing. Also, since phosphorus is expected to concentrate in the residuum, processing or product options for the latter may become limited. Applicants' invention addresses the need for additional phosphorus-free inhibitors.

SUMMARY OF THE INVENTION

An embodiment of the present invention is a method for inhibiting high temperature corrosion of corrosion prone metal surfaces caused by organic naphthenic acids in petroleum streams by providing the metal surface with an effective, corrosion-inhibiting amount of triphenylstibine.

Another embodiment of the invention is a method to inhibit the high temperature corrosivity of an organic acid-containing petroleum stream or oil by providing a corrosion prone metal-containing surface to be exposed to the acid-containing petroleum stream with an effective, corrosion-inhibiting amount of triphenyistibine at a temperature and under conditions sufficient to inhibit corrosion of the metal surface. The providing of the inhibitor may be carried out in the presence of the acid-containing petroleum stream; and/or as a pretreatment of the corrosion prone metal surface before exposure to the acid-containing petroleum stream. Another embodiment provides for the compositions produced by the process.

The present invention may suitably comprise, consist or consist essentially of the elements or steps disclosed and may be practiced in the absence of an element or step not disclosed.

DETAILED DESCRIPTION OF THE INVENTION

Some petroleum streams, including petroleum oils, contain acids, including organic acids such as naphthenic acids that contribute to high temperature corrosion of internal surfaces of refinery equipment. Organic acids generally fall within the category of naphthenic and other organic acids. Naphthenic acid is a generic term used to identify a mixture of organic carboxylic acids present in petroleum stocks. Naphthenic acids may be present either alone or in combination with other organic acids, such as phenols. Naphthenic acids alone or in combination with other organic acids can cause corrosion at high temperatures in non-aqueous or essentially non-aqueous (hydrocarbon) environments i.e. at temperatures ranging from about 200° C. (392° F.) to 420° C. (790° F.). Inorganic acids also may be present. Inhibition of corrosion due to the organic acid content of such petroleum streams, is desirable in order to increase the corrosion resistance, and thus useful life of internal (i.e., tube-side surfaces of reactors and other equipment having an external or shell side and an internal or tube side) metal surfaces that are high temperature corrosion prone and are to be exposed to organic acid-containing petroleum streams. It is particularly desirable to provide for mitigation options that use phosphorus-free compounds as additives or inhibitors, since phosphorus can affect downstream catalysts and/or product quality. Examples of such equipment include heat exchanger surfaces, pipestill vessels, transfer lines and piping, and pumps.

Petroleum streams that can be treated herein are any organic acid-containing petroleum streams, including whole crudes and crude oil fractions. As used herein, the term whole crudes means unrefined, non-distilled crudes.

Treatment temperatures will preferably range from about ambient to typically about 450° C., preferably up to 350° C.

Examples of metal surfaces that may benefit from treatment are ferrous metals such as carbon steel and non-alloys.

The inhibitor is introduced in either a batch or continuous process to untreated (unadditized) petroleum oil. Additionally or separately, the metal surface may be preconditioned by adding to a low acidity petroleum oil an amount of triphenyistibine effective to inhibit corrosion in the organic acid-containing petroleum oil to be treated before combination with the petroleum stream containing organic acids and blending them by techniques known in the industry. Additional effective amounts may be introduced into the organic acid-containing petroleum stream itself as needed to maintain corrosion inhibition. Desirably, a continuous dosing of the inhibitor to achieve and maintain the effective level of corrosion inhibition is delivered. Typically a reduction corresponding to at least a forty (40) percent corrosion rate reduction can be achieved. Thus, the additive/inhibitor may be introduced to the hydrocarbon-rich environment or phase and/or to the metal surface itself.

The triphenylstibine is added in effective amounts, typically up to a total of 1000 wppm, more typically an effective amount of from about 10–100 wppm.

The effectiveness of corrosion inhibition is typically estimated in the laboratory by weight loss of metal coupons exposed to organic acids with and without triphenylstibine present. The relative decrease in metal weight loss due to the presence of the corrosion inhibitor is a measure of the effectiveness of corrosion inhibition.

Naphthenic acid concentration in crude oil is determined by titration of the oil with KOH, until all acids have been neutralized. The concentration is reported in Total Acid Number (TAN) unit, i.e. mg of KOH needed to neutralize 1 gram of oil. It may be determined by titration according to ASTM D-664. Any acidic petroleum oil may be treated according to the present invention, for example, oils having an acid neutralization of about 0.5 mg. KOH/g. or greater.

The following examples illustrate the invention.

Example 1

The reaction apparatus consisted of a 500-ml round bottom flask under nitrogen atmosphere. 288.9 grams of Tufflo oil was put in the flask, then 12 mg of triphenylstibine were added. The flask contents were brought to 300° C. and a carbon steel coupon with dimensions 7/16 in.×11/16 in.×1/8 in. was immersed. Initial coupon weight was determined to be 4.7645 g. After an hour, 11.1 grams of naphthenic acids were added, giving a total acid number of 8 mg KOH/g. The oil was kept at 300° C. for an additional 4 hours. The coupon weighted 4.7606 g after this procedure, corresponding to a corrosion rate of 71 mils per year.

Examination of the coupon by scanning electron microscopy (SEM) showed the presence of 57.7 atom % Fe, 11 atom % oxygen and 31 atom % Sb. The presence of antimony (Sb) from the triphenylstibine on the surface of the metal coupon confirms its availability to offer corrosion protection.

Example 2 (Comparative)

The procedure was the same as in Example 1, but without triphenylstibine present. The coupon was kept in oil at 300° C. for four hours. The weight loss corresponded to a corrosion rate of 480 mils per year. Thus, in Example 1, an 85% corrosion rate reduction was measured when triphenylstibine was present versus Example 2 when this compound was absent.

Example 3

Example 1 was repeated, doubling the amount of triphenylstibine, i.e. using 24 mg. The measured weight loss corresponded to a corrosion rate of 44 mils per year. Thus, in Example 3, a 91% corrosion rate reduction was measured when triphenylstibine was present versus Example 2 when this compound was absent.

Examination of the coupon by SEM showed the presence of 29.4 atom % Fe, 21.7 atom % oxygen and 48 atom % Sb.

Example 4

Example 3 was repeated, increasing the reaction time from 4 hours to 22 hours. The measured weight loss corresponded to a corrosion rate of 48 mils per year. Comparison with Example 3 shows that the protection afforded by triphenylstibine is persistent.

Example 5

Example 1 was repeated, using a smaller amount of naphthenic acids. 295.8 g of Tufflo oil were put into the flask and 12 mg of triphenylstibine were added. A coupon was suspended in the flask for pre-treatment for 1 hour. 4.2 g of naphthenic acids were added to give a total acid number of 3 mg KOH/g. The oil was kept at 300° C. for an additional 4 hours. The coupon weight loss corresponded to a corrosion rate of 13 mils per year.

Example 6 (Comparative)

Example 2 was repeated, with same amounts of Tufflo oil and naphthenic acids as in Example 4. The measured weight loss corresponded to a corrosion rate of 141 mils per year.

Example 7 (Comparative)

Example 6 was repeated under exactly the same conditions. The measured weight loss corresponded to a corrosion rate of 130 mils per year. Thus, in Example 5, a 90–91% corrosion rate reduction was measured when triphenylstibine was present versus Examples 6 or 7 when this compound was absent.

What is claimed is:

1. A process for inhibiting the high temperature corrosivity occurring at from about 200° C. to 420° C. of an organic acid-containing petroleum stream when in contact with a corrosion prone metal-containing surface; said process is incorporating a corrosion inhibiting effective amount of triphenylstibine into said petroleum stream which is presently or is subsequently put in contact with said corrosion prone metal-containing surface.

2. The process of claim 1, wherein the amount of inhibitor is an effective amount of up to 1000 wppm.

3. The process of claim 1, wherein the metal is an iron-containing metal.

* * * * *